US010850555B2

(12) United States Patent
Rogers et al.

(10) Patent No.: US 10,850,555 B2
(45) Date of Patent: Dec. 1, 2020

(54) DRY ERASER AND ASSOCIATED SYSTEMS AND METHODS

(71) Applicant: Walmart Apollo, LLC, Bentonville, AR (US)

(72) Inventors: Sheila Kay Rogers, Bella Vista, AR (US); Crystal Lynn Lewis, Bentonville, AR (US); Steven Jackson Lewis, Bentonville, AR (US); Sosha Kay Morris, Bella Vista, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 130 days.

(21) Appl. No.: 15/690,588

(22) Filed: Aug. 30, 2017

(65) Prior Publication Data

US 2018/0056709 A1 Mar. 1, 2018

Related U.S. Application Data

(60) Provisional application No. 62/381,338, filed on Aug. 30, 2016.

(51) Int. Cl.
*B43L 19/00* (2006.01)

(52) U.S. Cl.
CPC ..... *B43L 19/0018* (2013.01); *B43L 19/0062* (2013.01)

(58) Field of Classification Search
CPC ..... A46B 11/001; A46B 11/002–0065; B43L 19/0018; B43L 19/0062
USPC ..... 401/132–139; 222/80–91, 541.2, 192, 222/325–327
See application file for complete search history.

(56) References Cited

U.S. PATENT DOCUMENTS 873,550 A * 12/1907 Hudson ..... A46B 11/0041 401/39
2,127,794 A * 8/1938 Wastman ..... A46B 11/00 222/387
2,490,440 A * 12/1949 Jacobs ..... A46B 11/0041 222/328
2,828,500 A * 4/1958 Peacock ..... A47L 1/08 401/137
2,859,463 A * 11/1958 Hirsch ..... A47L 1/08 401/139
2,972,768 A * 2/1961 Petion ..... A47L 23/05 401/27
3,031,711 A * 5/1962 Herman ..... A47L 23/05 401/27
3,110,917 A 11/1963 McPeek
(Continued)

FOREIGN PATENT DOCUMENTS

JP H11-18987 A 1/1999

*Primary Examiner* — Paul R Durand
*Assistant Examiner* — Randall A Gruby
(74) *Attorney, Agent, or Firm* — McCarter & English, LLP

(57) ABSTRACT

An example dry eraser and associated systems and methods are described. The example dry eraser includes a body including a top wall, a bottom wall, a front wall, a rear wall, and first and second side walls. The body includes a first hollow inner compartment configured and dimensioned to receive therein a cleaning fluid that is configured to be dispensed from the first hollow inner compartment via a nozzle disposed proximate to the front or rear wall of the body. The dry eraser includes an erasure material disposed on at least a portion of the bottom wall of the body.

10 Claims, 8 Drawing Sheets

(56) References Cited

U.S. PATENT DOCUMENTS 3,118,166 A * 1/1964 Bell ..... A47L 1/08 401/25
3,135,990 A * 6/1964 Bergmann ..... A46B 11/0017 401/286
3,328,830 A * 7/1967 Corwin ..... A47L 13/22 401/6
3,397,818 A 8/1968 Rey
3,444,579 A 5/1969 Thomford
3,603,692 A * 9/1971 Ball ..... A47L 1/08 401/139
3,704,072 A * 11/1972 Kaufman ..... A46D 1/00 401/291
3,713,744 A * 1/1973 Sims ..... A47L 13/22 401/9
3,837,747 A * 9/1974 Seymore ..... A47L 1/08 401/25
D236,072 S * 7/1975 Tsang et al. ..... D32/41
4,183,684 A * 1/1980 Avery, Jr. ..... A45D 34/04 15/244.1
4,415,288 A * 11/1983 Gordon ..... A47K 7/028 401/132
4,481,126 A * 11/1984 Trinh ..... C11D 3/222 134/4
4,543,680 A * 10/1985 Vlahos ..... A47L 13/46 15/145
4,693,840 A * 9/1987 Trinh ..... C11D 3/222 106/11
D294,989 S * 3/1988 Jinkins ..... 401/139
4,776,716 A * 10/1988 Huang ..... A47L 1/08 15/172
4,873,728 A 10/1989 Bono
4,903,365 A * 2/1990 Kaufman ..... A47L 13/10 15/110
4,925,327 A * 5/1990 Wirt ..... A61M 35/006 401/132
4,955,747 A * 9/1990 Tarver ..... A47L 13/30 15/145
D318,158 S * 7/1991 Ediger ..... 401/139
5,267,369 A * 12/1993 O'Neil ..... A46B 5/0025 15/160
5,362,165 A * 11/1994 Kluga ..... E04F 21/241 15/235.4
5,540,354 A 7/1996 Armand
5,595,223 A * 1/1997 Hayao ..... B41J 2/17503 141/18
5,704,471 A 1/1998 Yamada
6,250,831 B1 * 6/2001 Craven ..... A47L 1/08 401/137
6,321,941 B1 * 11/2001 Argentieri ..... B05B 9/0861 222/81
6,639,185 B1 10/2003 McConnell et al.
6,742,951 B2 * 6/2004 Schultz ..... A47L 1/15 401/137
6,960,349 B2 11/2005 Shantz et al.
7,195,677 B2 3/2007 Morrisey-Hawkins
7,261,701 B2 * 8/2007 Davis ..... A61M 35/006 604/3
7,264,414 B2 * 9/2007 McReynolds ..... A47L 1/15 401/136
7,309,181 B2 * 12/2007 Hawkins ..... B43K 23/001 401/131
7,470,078 B2 * 12/2008 Banco ..... A47L 1/08 401/139
7,549,815 B2 * 6/2009 Wong ..... A46B 11/0041 401/133
7,572,079 B2 * 8/2009 Wong ..... A46B 11/0041 222/83
7,731,056 B2 6/2010 Tramontina
7,967,520 B2 * 6/2011 Hawkins ..... B43L 21/00 15/209.1
8,044,325 B1 10/2011 Cooper
8,186,897 B2 * 5/2012 Kaufman ..... A45D 34/042 401/133
8,348,913 B2 * 1/2013 Hoang ..... A61B 90/80 604/310
8,556,529 B2 * 10/2013 Law ..... A61M 35/006 401/133
8,684,619 B2 * 4/2014 Uchiyama ..... A46B 5/0058 401/270
8,834,055 B2 * 9/2014 Uchiyama ..... A46B 5/0058 401/270
9,016,967 B2 * 4/2015 Law ..... A61M 35/006 401/134
9,498,094 B2 11/2016 Van Diepen
10,136,789 B2 * 11/2018 Zohar ..... C11D 17/041
10,405,643 B2 * 9/2019 Wu ..... A46B 11/0041
2002/0030045 A1 3/2002 Nakamura et al.
2004/0205919 A1 10/2004 Sims
2005/0260028 A1 * 11/2005 Gu ..... A46B 11/0058 401/188 R
2006/0000043 A1 * 1/2006 Jou-Chen ..... A47L 13/16 15/231
2006/0249524 A1 11/2006 Headrick
2007/0193597 A1 * 8/2007 Hurwitz ..... A01K 13/002 132/114
2008/0142535 A1 6/2008 Adler et al.
2008/0217354 A1 9/2008 Newman et al.
2008/0289993 A1 11/2008 Flannery
2010/0067972 A1 * 3/2010 Ashworth ..... A47L 13/34 401/270
2011/0011767 A1 1/2011 Gehring et al.
2011/0011879 A1 1/2011 Johnson
2011/0052307 A1 * 3/2011 Weng ..... A47L 25/00 401/139
2011/0240514 A1 10/2011 Bandoh et al.
2013/0047358 A1 * 2/2013 Shafer ..... A46B 11/0017 15/114
2016/0144654 A1 * 5/2016 Green ..... B43K 23/001 15/105.51
2018/0056708 A1 3/2018 Rogers et al.
2018/0056710 A1 * 3/2018 Boettcher ..... B43L 21/04
2019/0118573 A1 * 4/2019 Nelson, Jr. ..... B43L 19/00

* cited by examiner

DRY ERASER AND ASSOCIATED SYSTEMS AND METHODS

CROSS-REFERENCE TO RELATED PATENT APPLICATIONS

This application claims priority to U.S. Provisional Application No. 62/381,338 filed on Aug. 30, 2016, the content of which is hereby incorporated by reference in its entirety.

BACKGROUND

Whiteboards are used in a variety of settings, such as schools and businesses, for teaching or brainstorming sessions. Dry-erase markers are generally used to write on the whiteboard, and dry erasers including a non-abrasive surface are used to remove the writing from the whiteboard. Using the dry eraser on its own to remove the writing on the whiteboard can leave remnants of the dry-erase marker on the whiteboard, and writing on a whiteboard for an extended period of time can result in difficulty in removing all of the dry-erase marker writing.

SUMMARY

Exemplary embodiments of the present disclosure provide a dry eraser that includes a hollow inner chamber that can be filled with a cleaning fluid. The dry eraser further includes a nozzle for dispensing the cleaning fluid from the hollow inner chamber. The cleaning fluid can thereby be dispensed directly on the whiteboard or on a cleaning material (e.g., a paper towel, fabric material, or the like) for cleaning the whiteboard. In some embodiments, the dry eraser includes a wipe cloth configured to be extended from the dry eraser for wiping the whiteboard with or without the cleaning fluid. Thus, rather than locating paper towels and a cleaning fluid for cleaning the whiteboard, the user can dispense the cleaning fluid directly from the dry eraser and use the incorporated wipe cloth for cleaning the whiteboard, simplifying the overall process for the user.

In accordance with embodiments of the present disclosure, an exemplary dry eraser is provided. The dry eraser includes a body including a top wall, a bottom wall, a front wall, a rear wall, and first and second side walls. The body includes a first hollow inner compartment configured and dimensioned to receive therein a cleaning fluid that is configured to be dispensed from the first hollow inner compartment via a nozzle disposed proximate to the front or rear wall of the body. The dry eraser includes an erasure material disposed on at least a portion of the bottom wall of the body.

In some embodiments, the erasure material can be a non-abrasive material (e.g., felt, or the like). The dry eraser can include a magnetic component mounted to the outside of the body or incorporated within the body for detachably securing the dry eraser to surrounding metal objects during storage. In some embodiments, the top wall of the body can include an opening extending into the first hollow inner compartment. The opening can be configured and dimensioned to receive therein a cartridge with the cleaning fluid. A puncturing mechanism can be disposed within the first hollow inner compartment of the body, such that introduction of the cartridge with the cleaning fluid into the first hollow inner compartment automatically punctures a portion of the cartridge on the puncturing mechanism to release the cleaning fluid from the cartridge and into a channel leading to the nozzle.

In some embodiments, at least one of the front wall, the rear wall, the first side wall, or the second side wall can include an opening formed therein. The first hollow inner compartment can be configured to be filled with the cleaning fluid through introduction of the cleaning fluid into the opening. In some embodiments, at least one of the front wall, the rear wall, the first side wall, or the second side wall can include an opening formed therein. The opening can be configured and dimensioned to receive therethrough a cartridge with the cleaning fluid to be disposed within the first hollow inner compartment.

At least one of the front wall, the rear wall, the first wall, the second wall, or the top wall can include a transparent window providing a view into the first hollow inner compartment for visualizing a fullness level of the first hollow inner compartment with the cleaning fluid. In some embodiments, the cleaning fluid can be dispensed from the nozzle by squeezing the body of the dry eraser. In some embodiments, the dry eraser includes an actuator configured to be depressed. Depression of the actuator dispenses the cleaning fluid from the nozzle.

In some embodiments, the dry eraser includes a wipe cloth detachably secured to the top wall of the body. In some embodiments, the body can include a second hollow inner compartment with a wipe cloth disposed therein and at least one of the front wall, the rear wall, the first side wall, or the second side wall includes an opening extending into the second hollow inner compartment. The dry eraser can include an actuator configured to be depressed or slid. Depression or sliding of the actuator extends at least a portion of the wipe cloth from the opening.

In accordance with embodiments of the present disclosure, an exemplary dry eraser system is provided. The dry eraser system includes a container including a cleaning fluid and a dry eraser. The dry eraser includes a body including a top wall, a bottom wall, a front wall, a rear wall, and first and second side walls. The body includes a first hollow inner compartment configured and dimensioned to receive therein the cleaning fluid. The front or rear wall of the body can include a nozzle for dispensing the cleaning fluid from the first hollow inner compartment. The dry eraser further includes an erasure material disposed on at least a portion of the bottom wall of the body.

In accordance with embodiments of the present disclosure, an exemplary method of dispensing a cleaning fluid is provided. The method includes providing a dry eraser as disclosed herein. The method includes introducing the cleaning fluid into the first hollow inner compartment. The method includes actuating the dry eraser to dispense the cleaning fluid from the nozzle.

In some embodiments, introducing the cleaning fluid into the first hollow inner compartment can include introducing a cartridge with the cleaning fluid into the first hollow inner compartment. In some embodiments, introducing the cleaning fluid into the first hollow inner compartment can include filling the first hollow inner compartment with the cleaning fluid through an opening formed in at least one of the front wall, the rear wall, the first side wall, or the second side wall. In some embodiments, the method can include actuating the dry eraser to dispense the cleaning fluid from the nozzle comprises squeezing the body of the dry eraser. In some embodiments, actuating the dry eraser to dispense the cleaning fluid from the nozzle can include depressing an actuator on the body. In some embodiments, the method can include depressing an actuator to extend a wipe cloth from a second hollow inner compartment formed in the body.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed dry erasers and associated systems and methods, reference is made to the accompanying figures, wherein.

DETAILED DESCRIPTION

Figure 1:
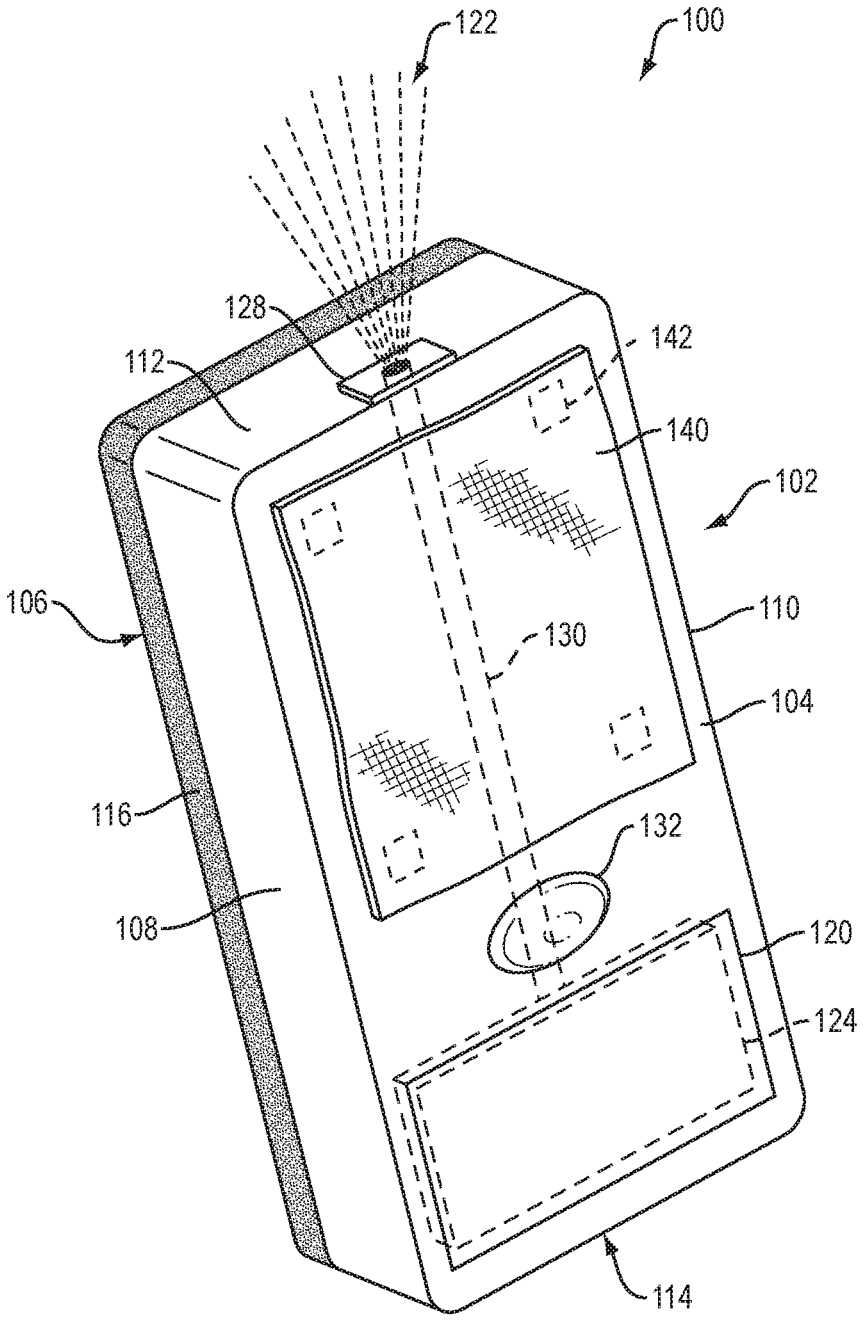
FIG. 1 is a schematic perspective view of an exemplary dry eraser of the present disclosure.

It should be understood that the relative terminology used herein, such as "front", "rear", "left", "top", "bottom", "vertical", "horizontal", "up" and "down" is solely for the purposes of clarity and designation and is not intended to limit embodiments to a particular position and/or orientation. Accordingly, such relative terminology should not be construed to limit the scope of the present disclosure. In addition, it should be understood that the scope of the present disclosure is not limited to embodiments having specific dimensions. Thus, any dimensions provided herein are merely for an exemplary purpose and are not intended to limit the invention to embodiments having particular dimensions.

Exemplary embodiments of the present disclosure provide a dry eraser that includes a hollow inner chamber that can be filled with a cleaning fluid. In particular, the dry eraser includes a non-abrasive erasure material on one side of the body, and further includes a nozzle for dispensing the cleaning fluid from the hollow inner chamber. The dry eraser can include a wipe cloth that is secured to the body or extended out of an inner chamber of the body. The cleaning fluid can therefore be dispensed directly on the whiteboard or on a cleaning material for cleaning the whiteboard, and the wipe cloth can be used to further clean the whiteboard. Thus, rather than locating paper towels and a cleaning fluid for cleaning the whiteboard, the user can dispense the cleaning fluid directly from the dry eraser and use the incorporated wipe cloth for cleaning the whiteboard, simplifying the overall process for the user.

FIGS. 1-4 show perspective, top, side and cross-sectional views of an exemplary dry eraser 100. The dry eraser 100 include a body 102 with a top wall 104, a bottom wall 106, a first side wall 108, a second side wall 110, a front wall 112 and a rear wall 114. In some embodiments, one or more walls of the body 102 can include graphics, skins and/or logos thereon. The bottom wall 106 includes an erasure material 116 attached thereto and covering at least a portion of the bottom wall 106. The erasure material 116 can be fabricated from a non-abrasive material, such as felt, and can be used to wipe the surface of a whiteboard. In some embodiments, one or more portions of the body 102 can include a magnetic component 118 mounted thereon or incorporated therein. The magnetic component 118 can be used to detachably position the dry eraser 100 on a surrounding metal object for storage of the dry eraser 100 during non-use.

Figure 2:
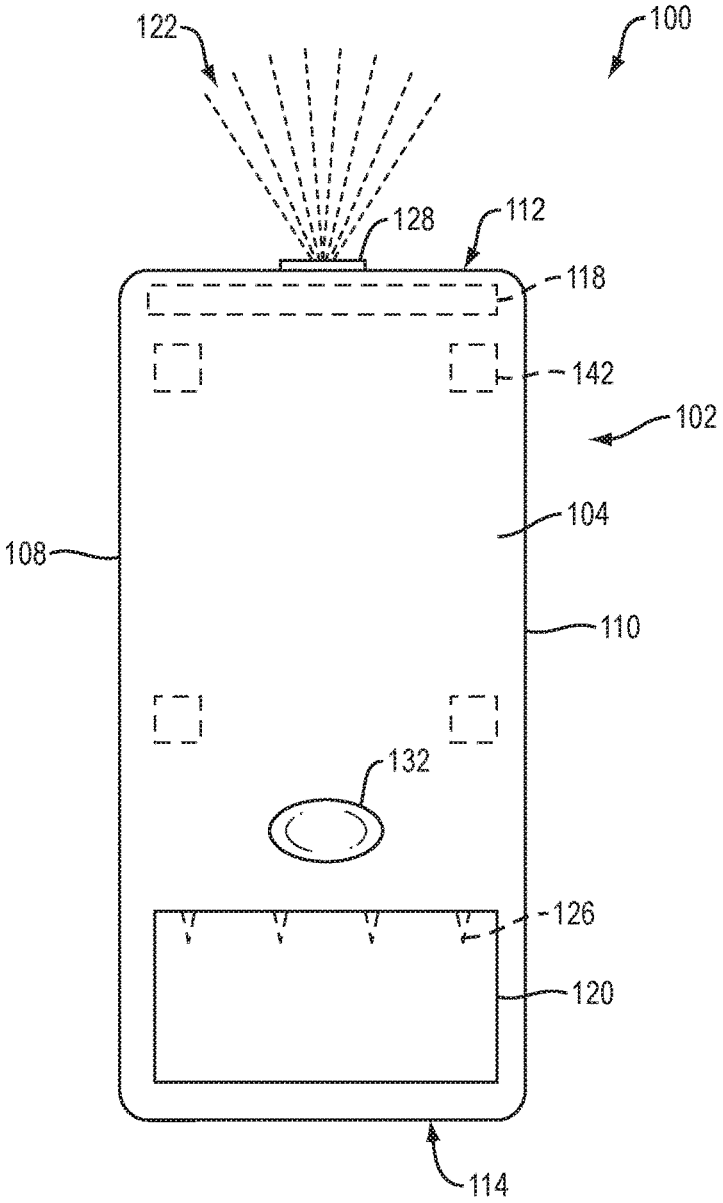
FIG. 2 is schematic top view of an exemplary dry eraser of the present disclosure.

The body 102 includes a hollow inner chamber or compartment 120 (e.g., a first hollow inner compartment) formed therein. The hollow inner compartment 120 can be configured and dimensioned to receive therein a cleaning fluid 122. In some embodiments, the hollow inner compartment 120 can be formed as a recessed area extending inwardly from the top wall 104 a partial distance towards the bottom wall 106 (e.g., FIGS. 1 and 2). In such embodiments, the recessed area of the hollow inner compartment 120 can be configured and dimensioned to receive a cartridge 124 containing the cleaning fluid 122. The hollow inner compartment 120 can include a puncturing mechanism 126 (e.g., one or more barbs), as shown in FIG. 2, for puncturing a portion of the cartridge 124 when the cartridge 124 is positioned into the hollow inner compartment 120. Puncturing the cartridge 124 releases the cleaning fluid 122 into an inner portion of the hollow inner compartment 120, while the body of the cartridge 124 prevents the cleaning fluid 122 from leaking out of the top wall 104. In some embodiments, the dry eraser 100 includes a cover configured and dimensioned to secure over the hollow inner compartment 120 on the top wall 104 to seal the hollow inner compartment 120.

The hollow inner compartment 120 can be in fluidic communication with a nozzle 128 disposed proximate to the front wall 112 (or alternatively the rear wall 114) of the body 102 via an elongated internal channel 130. Thus, the cleaning fluid 122 introduced into the hollow inner compartment 120 can travel along the channel 130 to be dispensed via the nozzle 128. In some embodiments, the body 102 of the dry eraser 100 can be fabricated from a flexible material that can be squeezed to force the cleaning fluid 122 through the channel 130 and out of the nozzle 128. In some embodiments, the dry eraser 100 can include an actuator 132 (e.g., a depressible or slidable button) for dispensing the cleaning fluid 122 from the nozzle 128. In some embodiments, the actuator 132 can function through mechanical means to dispense the cleaning fluid 122 from the nozzle 128. In some embodiments, depression of the actuator 132 can activate an electrical circuit configured to control the dispensing of the cleaning fluid 122 through the nozzle 128. In such embodiments, the electrical circuit can be powered by one or more batteries, which can be housed by the body 102. It should be understood that the actuator 132 can be located on any wall of the body 102. In some embodiments, the hollow inner compartment 120 can receive a standard spray bottle filled with the cleaning fluid 122. One or more sides of the body 102 can include a transparent or substantially transparent window formed therein providing a view into the hollow inner compartment 120, thereby allowing a user to visualize the fullness level of the hollow inner compartment 120 (or the cartridge 124) with the cleaning fluid 122.

Figure 3:
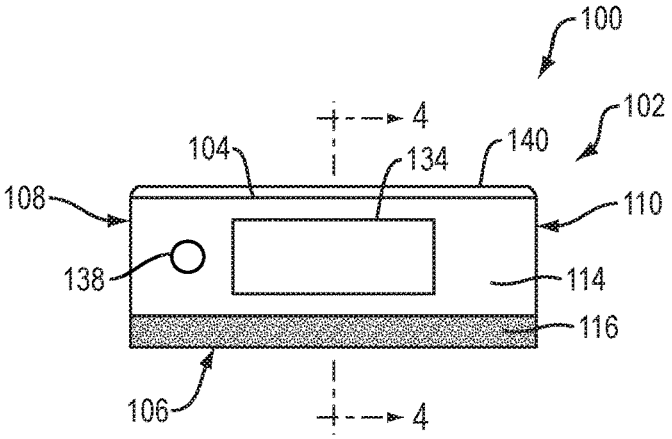
FIG. 3 is a schematic side view of an exemplary dry eraser of the present disclosure including an open lid.
Figure 4:
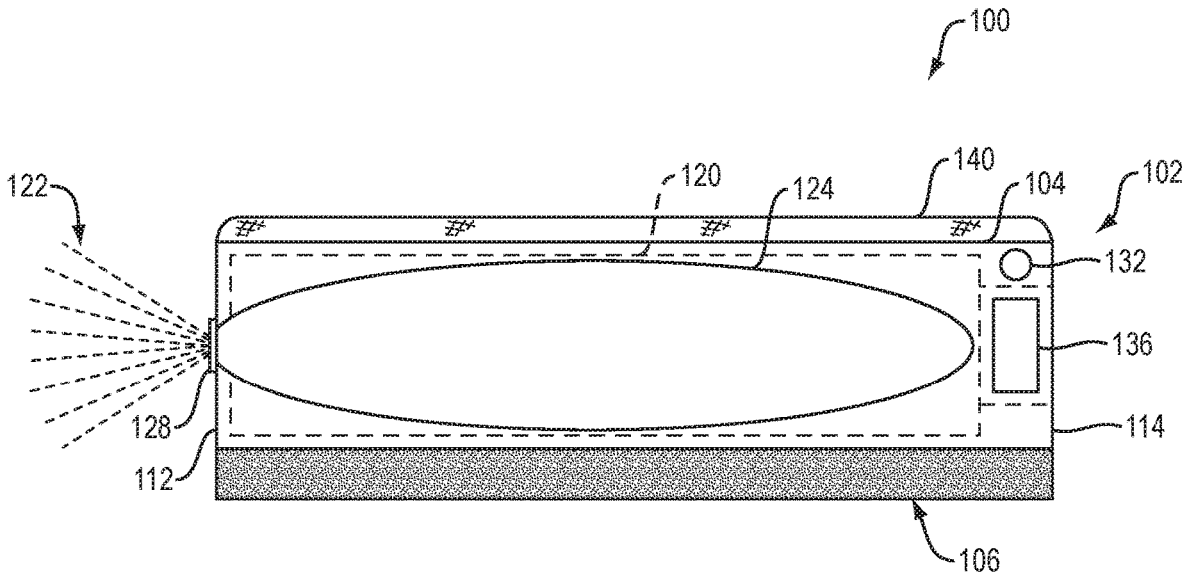
FIG. 4 is a schematic cross-sectional view of an exemplary dry eraser of the present disclosure taken along section line 4-4 of FIG. 3.

In some embodiments, the hollow inner compartment 120 can be formed internally within the body 102 (e.g., FIGS. 3 and 4). In particular, rather than extending from the top wall 104, the hollow inner compartment 120 can be enclosed by the top wall 104, the bottom wall 106 and the front wall 112, and the rear wall 114 can include an elongated opening 134 formed therein and extending into the hollow inner compartment 120. The elongated opening 134 can be configured and dimensioned to receive the cartridge 124 therethrough. Thus, the cartridge 124 can be slid through the elongated opening 134 and into the hollow inner compartment 120 until the puncturing mechanism 126 punctures at least a portion of the cartridge 124 to release the cleaning fluid 122. In some embodiments, a spring-loaded mechanism allows the cartridge 124 to be clicked or snapped into place and retained within the hollow inner compartment 120 for use. After the cleaning fluid 122 has been used, the cartridge 124 can be disengaged from the body 102 using the spring-loaded mechanism to remove the cartridge 124 from the hollow inner compartment 120. The body 120 includes a transparent window 136 for visualizing the fullness level of the cartridge 124 with the cleaning fluid 122. In some embodiments, the actuator 132 for dispensing the cleaning fluid 122 from the nozzle 128 can be located on the rear wall 114.

In some embodiments, rather than implementing a cartridge 124, the hollow inner compartment 120 can be filled with the cleaning fluid 122. For example, the rear wall 114 can include an opening 138 leading into the hollow inner compartment 120 configured and dimensioned to receive a dispensing portion of a container with the cleaning fluid 122. The dispensing portion of the container can be introduced into the opening 138, and the cleaning fluid 122 can be poured through the opening 138 and into the hollow inner compartment 120. A plug or similar device can be used to close the opening 138 prior to use of the dry eraser 100.

In some embodiments, the dry eraser 100 can include a wipe cloth 140 (e.g., a dry cloth) detachably secured to the body 102. For example, the top wall 104 and the wipe cloth 140 can include one or more complementary attachment mechanisms 142 (e.g., VELCRO™ strips, or the like) for detachably securing the wipe cloth 140 to the top wall 104. The cleaning fluid 122 can therefore be dispensed from the nozzle 128, and the wipe cloth 140 can be removed from the body 102 to clean the whiteboard. In some embodiments, the cleaning fluid 122 can be dispensed or sprayed on the wipe cloth 140, and the presoaked wipe cloth 140 can be used to clean the whiteboard. After use, the wipe cloth 140 can be attached to the appropriate position on the body 102 for storage.

Figure 5:
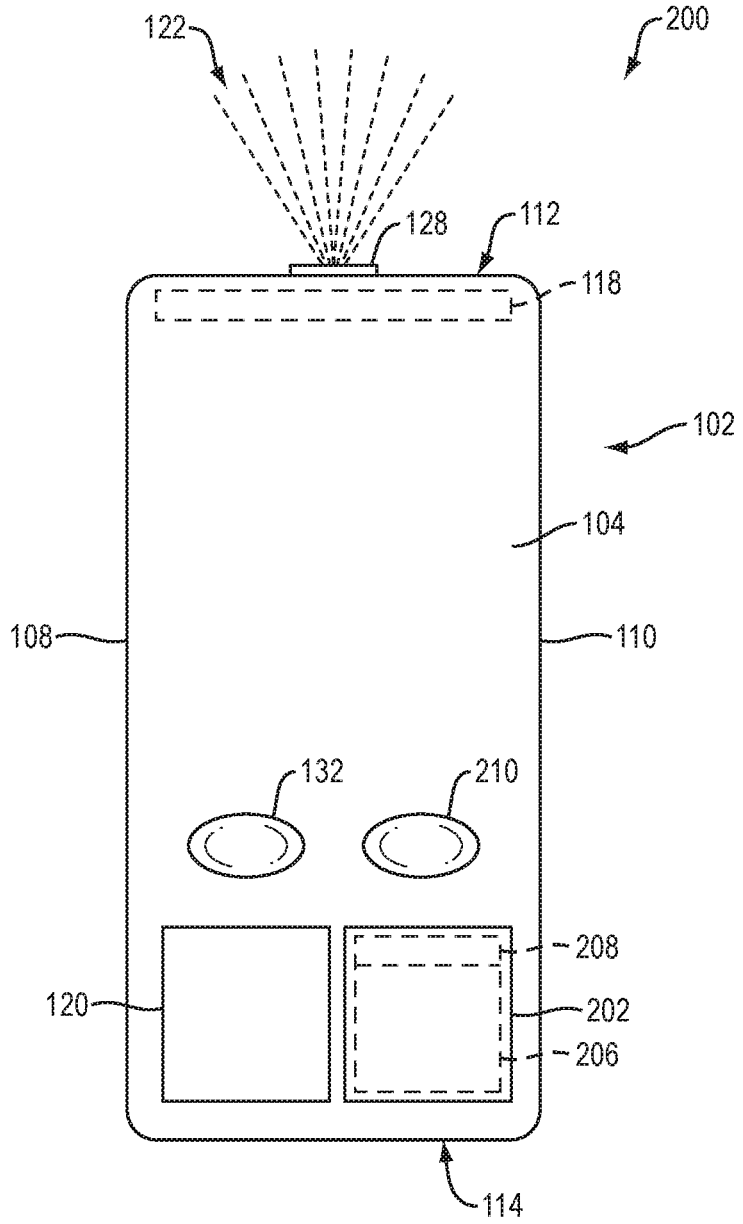
FIG. 5 is a schematic top view of an exemplary dry eraser of the present disclosure.
Figure 6:
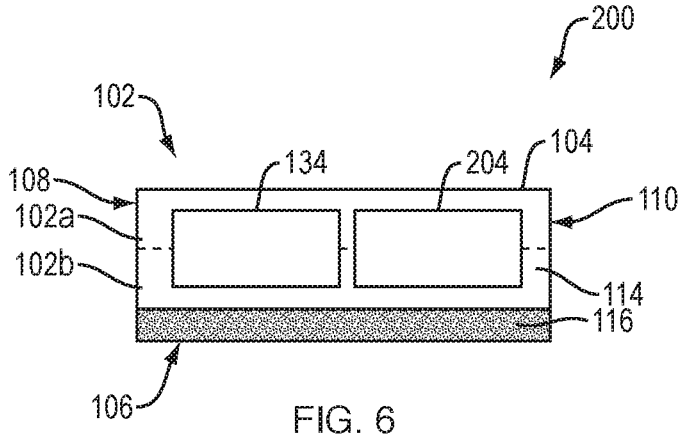
FIG. 6 is a schematic side view of an exemplary dry eraser of the present disclosure.

FIGS. 5 and 6 show an alternative embodiment of a dry eraser 200. The dry eraser 200 can be substantially similar in structure and function to the dry eraser 100, except for the distinctions noted herein. Therefore, like reference numbers are used to represent like structures. Rather than including a single hollow inner compartment 120, the dry eraser 200 includes a first hollow inner compartment 120 configured and dimensioned to receive the cleaning fluid 122 therein. Although illustrating as including the elongated opening 134 in the rear wall 114 for introduction of a cartridge 124 into the first hollow inner compartment 120, it should be understood that the first hollow inner compartment 120 can be formed as a recessed area in the top wall 104 of the body 102 or the rear wall 114 can include an opening 138 for introducing the cleaning fluid 122 directly into the first hollow inner compartment 120. The actuator 132 can be depressed or slid to dispense the cleaning fluid 122 from the nozzle 128.

The dry eraser 200 includes a second hollow inner compartment 202 formed internally within the body 102. The dry eraser 200 includes a second elongated opening 204 formed in, e.g., the rear wall 114, and extending into the second hollow inner compartment 202. The second hollow inner compartment 202 can be configured and dimensioned to retain therein a wipe cloth 206. In some embodiments, the wipe cloth 206 can be folded and inserted into the second hollow inner compartment 202 for storage. In some embodiments, the second hollow inner compartment 202 can include a mechanism 208 configured to rotate within the second hollow inner compartment 202.

The wipe cloth 206 can be at least partially wrapped around the mechanism 208 and an actuator 210 can be depressed or slid to rotate the mechanism 208 and extend the wipe cloth 206 from the elongated opening 204. In some embodiments, the actuator 210 can function through mechanical means to the wipe cloth 206 from the second hollow inner compartment 202. In some embodiments, depression of the actuator 210 can activate an electrical circuit configured to control the extension of the wipe cloth 206 (e.g., the rate of extension, the amount of extension, or the like). In such embodiments, the electrical circuit can be powered by one or more batteries, which can be housed by the body 102. In some embodiments, the mechanism 208 can be spring-loaded such that after release of the extended wipe cloth 206, the wipe cloth 206 automatically retracts into the second hollow inner compartment 202. It should be understood that the size and/or position of the first and second hollow inner compartments 120, 202 is provided for illustrative purposes only, and each of the first and second hollow inner compartments 120, 202 can be of different configurations/sizes and in different locations of the body 102.

In some embodiments, the body 102 can be formed from first and second body halves 102*a*, 102*b* that can be disengaged to expose at least the second hollow inner compartment 202 such that the wipe cloth 206 can be placed therein. In such embodiments, after placement of the wipe cloth 206 into the second hollow inner compartment 202, the two body halves 102*a*, 102*b* can be engaged or interlocked to maintain the wipe cloth 206 within the second hollow inner compartment 202. In some embodiments, the two body halves 102*a*, 102*b* can be disengaged to expose the first hollow inner compartment 120 for inserting a cleaning fluid cartridge 124 therein. Thus, rather than introducing the cartridge 124 and the wipe cloth 206 through the elongated openings 134, 204, respectively, introduction of such components can be performed by disengagement of the two body halves 102*a*, 102*b*.

Figure 7:
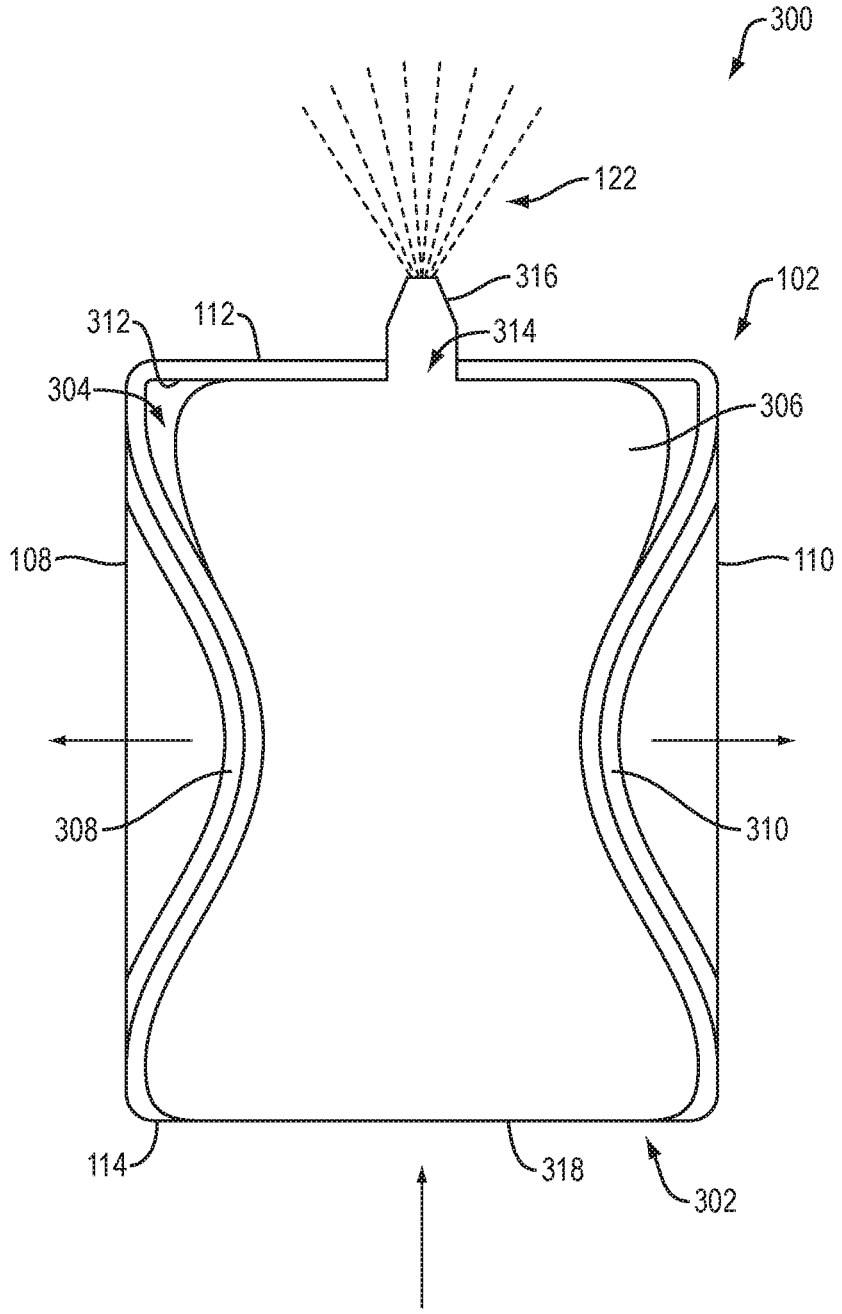
FIG. 7 is a schematic top view of an exemplary dry eraser of the present disclosure with a top wall omitted to show a hollow inner compartment.

FIG. 7 is a schematic top plan view showing an alternative embodiment of a dry eraser 300 with the top wall omitted to show the hollow inner compartment or chamber 304 of the dry eraser 300. The dry eraser 300 can be substantially similar in structure and function to the dry eraser 100, except for the distinctions noted herein. Therefore, like reference numbers are used to represent like structures. The dry eraser 300 includes an elongated opening 302 formed in the rear wall 114 and extending into a hollow inner compartment 304. The hollow inner compartment 304 can be configured and dimensioned to receive therein a dispenser container 306 (e.g., a spray bottle) with the cleaning fluid 122 therein.

In particular, the dispenser container 306 can be passed through the elongated opening 302 and into the hollow inner compartment 304.

The hollow inner compartment 304 can include resilient members 308, 310 (e.g., formed as arched spring steel) that are biased inwardly towards each other and away from side walls of the inner compartment 304. Initial introduction of the dispenser container 306 into the hollow inner compartment 304 can deflect or flex the resilient members 308, 310 outwardly away from each other. As the dispenser container 306 approaches an inner surface 312 of the front wall 112, the resilient members 308, 310 can gradually return to the inwardly biased position shown in FIG. 7. The inwardly biased resilient members 308, 310 can thereby engage the sides of the dispenser container 306 to removably secure the dispenser container 306 within the hollow inner compartment 304.

The front wall 112 of the body 102 can include a central opening 314 configured and dimensioned to receive therethrough a nozzle 316 of the dispenser container 306. As the dispenser container 306 is positioned against the inner surface 312 of the front wall 112, the nozzle 316 passes through the opening 314 and extends from the front wall 112 of the dry eraser 300. In such configuration, a rear wall 318 of the dispenser container 306 can be substantially aligned with the rear wall 114 of the dry eraser 300. The cleaning fluid 122 can be dispensed from the nozzle 316 by, e.g., squeezing the dry eraser 300, actuating an actuator disposed on the dry eraser 300, or the like.

To remove the dispenser container 306 from the hollow inner compartment 304 (e.g., for replacement or refilling), pressure can be imparted against the nozzle 316 in the direction of the rear wall 114 to overcome the biasing force of the resilient members 308, 310. Upon partial extension of the rear wall 318 of the dispenser container 306 from the elongated opening 302, the dispenser container 306 can be grasped and fully pulled out of the hollow inner compartment 304.

Figure 8:
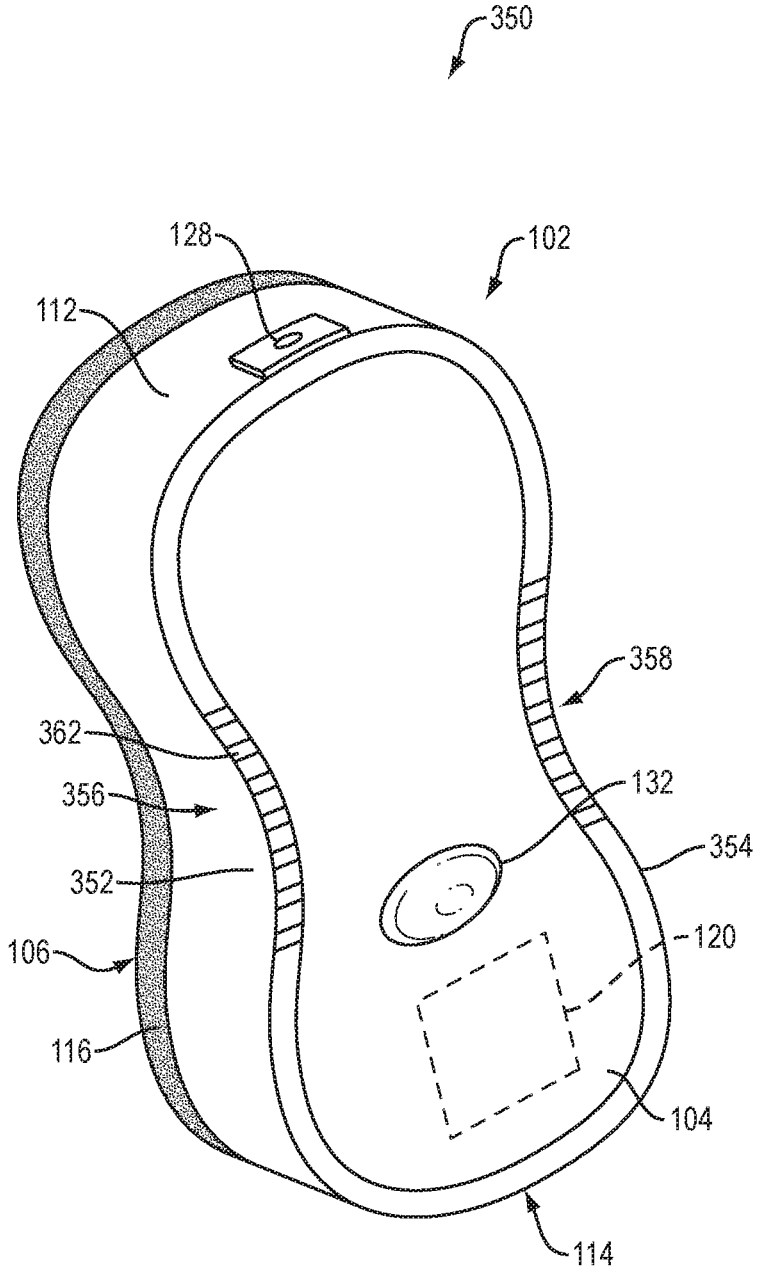
FIG. 8 is a perspective view of an exemplary dry eraser of the present disclosure including an ergonomic configuration.
Figure 9:
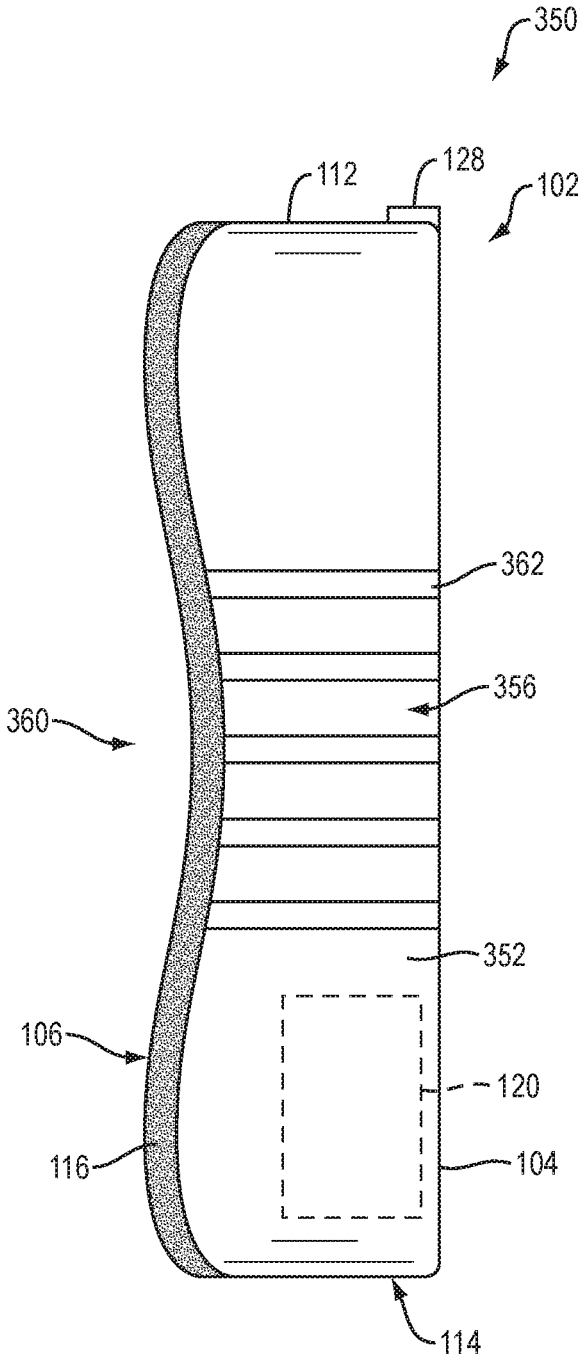
FIG. 9 is a side view of an exemplary dry eraser of the present disclosure including an ergonomic configuration.

FIGS. 8-9 show perspective and side views of an exemplary dry eraser 350 of the present disclosure. The dry eraser 350 can be substantially similar in structure and function to the dry eraser 100, 200, 300, except for the distinctions noted herein. Therefore, like reference numbers represent like structures. In particular, rather than including substantially linear first and second side walls 108, 110, the first and second side walls 352, 354 of the dry eraser 350 can be ergonomically shaped for a better or more comfortable fit in the hand of a user. For example, the first and second side walls 352, 354 can include concave central sections 356, 358 that gradually curve inwardly between the front and rear walls 112, 114. The concave central sections 356, 358 form a narrow central portion of the dry eraser 350 that acts as an improved gripping area for the user.

In some embodiments, the bottom wall 106 of the dry eraser 350 can also define a concave central section 360 that gradually transitions from the front and rear walls 112, 114. In some embodiments, the body 102 can be formed from a flexible material such that pressing the dry eraser 350 against a planar surface (e.g., a whiteboard) flexes the body 102 to position the entire bottom wall 106 against the surface (e.g., the concave central section 360 is flexed to define a substantially planar bottom wall 106 until force on the dry eraser 350 is removed).

In some embodiments, one or more walls of the dry eraser 350 can include features 362 (e.g., a textured surface, rubber strips, rubber surfaces, or the like) to further improve the grip of the user on the dry eraser 350. For example, as shown in FIGS. 8 and 9, the dry eraser 350 includes the features 362 along the concave central sections 356, 358 of the first and second side walls 352, 354. However, it should be understood that other portions of the first and second side walls 352, 354, and the front and rear walls 112, 114 can also include one or more of the features 362.

Figure 10:
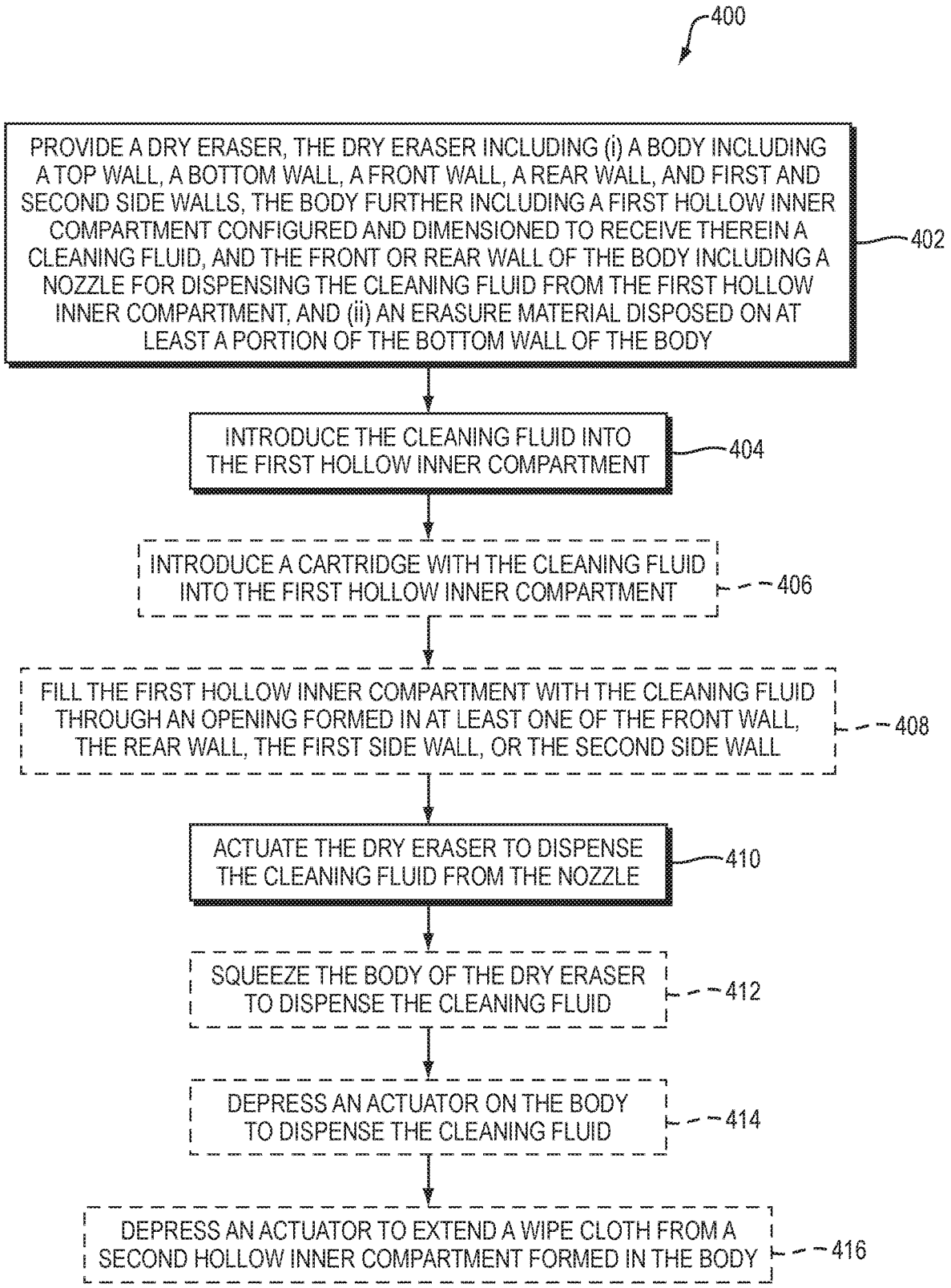
FIG. 10 is a flowchart illustrating a process of implementing an exemplary dry eraser in accordance with embodiments of the present disclosure.

FIG. 10 is a flowchart illustrating an exemplary process 400 of implementing a dry eraser. To begin, at step 402, a dry eraser as described herein is provided. At step 404, the cleaning fluid is introduced into the first hollow inner compartment. In some embodiments, at step 406, a cartridge with the cleaning fluid is introduced into the first hollow inner compartment. In some embodiments, at step 408, the first hollow inner compartment is filled with the cleaning fluid through an opening formed in at least one of the front wall, the rear wall, the first side wall or the second side wall.

At step 410, the dry eraser can be actuated to dispense the cleaning fluid from the nozzle. In some embodiments, at step 412, the body of the dry eraser is squeezed to dispense the cleaning fluid from the nozzle. In some embodiments, at step 414, an actuator on the body can be depressed or slid to dispense the cleaning fluid from the nozzle. In some embodiments, at step 416, an actuator can be depressed or slid to extend a wipe cloth from a second hollow inner compartment formed in the body.

Thus, in addition to a non-abrasive erasure material disposed on one side of the dry eraser, the exemplary dry eraser provides an inner compartment for storage of a cleaning fluid. In particular, the inner compartment can receive a cleaning fluid cartridge or can be filled directly with the cleaning fluid, and the dry eraser can be actuated to dispense the cleaning fluid from a nozzle onto the whiteboard or a cleaning material. The dry eraser can also include a wipe cloth stored on an outer surface of the body or within a second inner compartment. The wipe cloth can be removed or extended from the dry eraser for further cleaning of the whiteboard. Thus, rather than locating paper towels and cleaning fluid for cleaning the whiteboard, the user can dispense the cleaning fluid and the wipe cloth directly from the dry eraser, simplifying the overall process for the user.

While exemplary embodiments have been described herein, it is expressly noted that these embodiments should not be construed as limiting, but rather that additions and modifications to what is expressly described herein also are included within the scope of the present disclosure. Moreover, it is to be understood that the features of the various embodiments described herein are not mutually exclusive and can exist in various combinations and permutations, even if such combinations or permutations are not made express herein, without departing from the spirit and scope of the present disclosure.

The invention claimed is:

1. A dry eraser, comprising:

a body including a top wall, a bottom wall, a front wall, a rear wall, and first and second side walls, the body further including a first hollow inner compartment configured and dimensioned to receive therein a cleaning fluid that is configured to be dispensed from the first hollow inner compartment via a nozzle disposed proximate to the front or rear wall of the body, wherein the top wall of the body comprises an opening providing access into the first hollow inner compartment, the opening being configured and dimensioned to receive therein a cartridge with the cleaning fluid, at least one of the front wall, the rear wall, the first side wall, or the second side wall comprises a second opening formed therein, and wherein the first hollow inner compartment is configured to be filled with the cleaning fluid through introduction of the cleaning fluid into the second opening;

a puncturing mechanism disposed within the first hollow inner compartment of the body, such that the puncturing mechanism punctures a portion of the cartridge when the cartridge is positioned into the first hollow inner compartment to release the cleaning fluid from the cartridge and into a channel leading to the nozzle;

a magnetic component mounted to the outside of the body or incorporated within the body; and an erasure material disposed on at least a portion of the bottom wall of the body.

2. The dry eraser of claim 1, wherein the erasure material is felt.

3. The dry eraser of claim 1, wherein at least one of the front wall, the rear wall, the first side wall, or the second side wall comprises an opening formed therein, the opening being configured and dimensioned to receive therethrough the cartridge with the cleaning fluid to be disposed within the first hollow inner compartment.

4. The dry eraser of claim 1, comprising an actuator configured to be depressed, wherein depression of the actuator dispenses the cleaning fluid from the nozzle.

5. The dry eraser of claim 1, comprising a wipe cloth detachably secured to the top wall of the body.

6. A dry eraser system, comprising:

a cartridge including a cleaning fluid; and a dry eraser including:

a body including a top wall, a bottom wall, a front wall, a rear wall, and first and second side walls, the body further including a first hollow inner compartment configured and dimensioned to receive therein the cleaning fluid, and the front or rear wall of the body including a nozzle for dispensing the cleaning fluid from the first hollow inner compartment, wherein the top wall of the body comprises an opening providing access into the first hollow inner compartment, the opening being configured and dimensioned to receive therein the cartridge with the cleaning fluid;

a puncturing mechanism disposed within the first hollow inner compartment of the body, such that the puncturing mechanism punctures a portion of the cartridge when the cartridge is positioned into the first hollow inner compartment to release the cleaning fluid from the cartridge and into a channel leading to the nozzle;

a magnetic component mounted to the outside of the body or incorporated within the body;

an erasure material disposed on at least a portion of the bottom wall of the body; and a wipe cloth detachably secured to the top wall of the body.

7. The dry eraser system of claim 6, wherein the erasure material is felt.

8. The dry eraser system of claim 6, wherein at least one of the front wall, the rear wall, the first side wall, or the second side wall comprises a second opening formed therein, and wherein the first hollow inner compartment is configured to be filled with the cleaning fluid through introduction of the cleaning fluid into the second opening.

9. The dry eraser system of claim 6, wherein at least one of the front wall, the rear wall, the first side wall, or the second side wall comprises an opening formed therein, the opening being configured and dimensioned to receive therethrough the cartridge with the cleaning fluid to be disposed within the first hollow inner compartment.

10. The dry eraser system of claim 6, wherein the dry eraser comprises an actuator configured to be depressed, wherein depression of the actuator dispenses the cleaning fluid from the nozzle.

* * * * *